United States Patent [19]

Westdale

[11] 4,430,407

[45] Feb. 7, 1984

[54] HEAT FUSIBLE SINGLE COMPONENT TONER HAVING A POLYAMIDE BINDER

[75] Inventor: Virgil W. Westdale, Barrington, Ill.

[73] Assignee: AM International, Inc., Chicago, Ill.

[21] Appl. No.: 362,534

[22] Filed: Mar. 26, 1982

[51] Int. Cl.[3] ..... G03G 9/14

[52] U.S. Cl. ..... 430/106.6; 430/109; 430/111; 430/903

[58] Field of Search ..... 430/106.6, 108, 122, 430/109, 111, 903

[56] References Cited

U.S. PATENT DOCUMENTS

| | | | |
|---|---|---|---|
| 3,345,294 | 10/1967 | Cooper | 430/106.6 |
| 4,082,681 | 4/1978 | Takayama et al. | 252/62.1 P |
| 4,189,390 | 2/1980 | Noguchi et al. | 430/903 |
| 4,218,530 | 8/1980 | Lu | 430/106.6 |
| 4,238,558 | 12/1980 | Ziolo | 430/108 |
| 4,251,616 | 2/1981 | Hendriks | 430/106.6 |
| 4,256,818 | 3/1981 | Blossey et al. | 430/106.6 |

*Primary Examiner*—John E. Kittle
*Assistant Examiner*—John L. Goodrow
*Attorney, Agent, or Firm*—Nicholas A. Camasto; Donald C. Kolasch

[57] ABSTRACT

A single component electrophotographic developer composition is disclosed comprising a low melt viscosity polyamide resin and a magnetic oxide component of such particle size as to greatly enhance the development of low background high density images. Highly conductive carbon may be added to control the resistivity of the developer particles.

4 Claims, 2 Drawing Figures

HEAT FUSIBLE SINGLE COMPONENT TONER HAVING A POLYAMIDE BINDER

BACKGROUND OF THE INVENTION

The present invention relates to toner powder for use in electrophotography, and, more specifically, to a heat-fusible toner composition used for the development of electrostatic latent images such as those formed on an insulating or photoconductive insulating surface in the electrophotographic imaging arts.

In electrophotographic printing, generally a uniform electrostatic charge is applied to a photoconductive insulating layer and the resulting charged surface selectively exposed to electromagnetic radiation so as to dissipate the charge in those areas exposed to the radiation thereby producing an electrostatic latent image. The resulting latent image is subsequently developed by depositing a finely divided electroscopic developer material, referred to as toner, on the electrostatically formed image. Generally speaking, the charged toner particles will have a charge opposite to the residual electrostatic charge image so that the toner particles adhere to the charged areas to form a visible image. This image may be fixed in situ on the support or transferred to a secondary support surface and the transferred image permanently affixed to the secondary support surface.

Two component developer mixtures are conventionally used to develop the images comprising a pigmented resinous toner powder and a carrier component wherein the carrier component is substantially larger in size than its toner complement. The toner particles, which are generally made up of a fine pigmented resinous material, are charged triboelectrically by rubbing against the carrier particles causing them to adhere electrostatically thereto. The composition of the developer mix is chosen such that the toner particles will acquire an electrostatic charge of a polarity opposite to that of the electrostatic image to be developed. As a result, when the developer is brought into contact with the electrostatic latent image, the toner particles are attracted from the carrier particles and selectively deposited onto the electrostatic image by the electrostatic charge of the image. The powder or toner image that is obtained is either fixed in situ on the surface of the image-bearing substrate or the powder image selectively transferred to a receiving surface to which it is then fixed. The fixing process can reflect any one of several approaches such as pressure fixing, vapor fixing or heat fusing, depending upon the specifics of the particular system. In another form of development utilizing a developer mix comprising a carrier and toner component, a developer composition containing toner and magnetic carrier particles is transported by a magnet. The resulting magnetic field causes alignment of the magnetic carrier into a brush-like configuration. This magnetic brush is engaged with the electrostatic image-bearing surface, and the toner particles supported on the brush-like configuration, are drawn from the "brush" to the latent image by electrostatic attraction. Thus, a developer mixture may be provided comprising a toner material and a carrier material which consists of particles which are magnetically attractable. Such a configuration is generally referred to as a magnetic brush development system.

Although the above development systems have been found useful in electrophotography, they are not without their disadvantages. For example, in the use of a developer mix comprising both the toner and carrier components, in combination with a heat-fusible image fixing system, mix fatique is encountered which generally results in poor copy images and the masters produced therefrom have relatively short periods of usage time. The carrier component slowly is reduced in size and becomes increasingly coated with toner, producing a resulting change in the triboelectric charge relationship, thus leading to a lower quality image. Furthermore, in the reproduction of high-contrast copies utilizing the powder-carrier developer mix wherein the mutual electrification of the components is governed by the distance between their relative positions in the triboelectric series, when otherwise compatible electroscopic powder and carrier materials are removed from each other in the triboelectric series by too great a distance, the resulting images are very faint because the attractive forces between the carrier and toner particles compete with the attractive forces between the electrostatic latent image and the toner particles. It is, therefore, readily apparent that many materials which otherwise have suitable properties for employment as carrier particles are unsuitable because they possess unsatisfactory triboelectric properties. In addition, uniform triboelectric surface characteristics of many carrier surfaces are difficult to achieve with mass production techniques.

Heretofore, a single component toner material has been provided for use in combination with pressure-fusing systems which eliminates the need for the presence of the carrier component, with a certain degree of success, since the toner, as a result of its formulation, including a magnetic component, serves as its own carrier and, thus, is useful in the development of electrostatic latent images in electrophotography. However, due to the preferred use of heat-fusing techniques in fixing the resulting developed image to produce a more reliable and permanent image, it is preferred to utilize a single component toner material which is compatible with a heat fusing system so as to enhance the results of the specific electrophotographic imaging system.

SUMMARY OF THE INVENTION

Therefore, it is an object of the present invention to provide an electrophotographic imaging system which will overcome the above-noted and other disadvantages.

It is a further object of the present invention to provide an improved developer composition for use in an electrophotographic imaging process which eliminates the conventionally used carrier component.

Another object of the present invention is to provide a single component developer composition.

Yet, a further object of the present invention is to provide a single component developer composition useful in electrophotography, wherein the resulting developed image is fixed by heat fusing, in the absence of pressure.

Still a further object of the present invention is to provide a single component, heat-fusible toner composition suitable for use in an electrophotographic imaging process.

The foregoing objects and others are accomplished in accordance with the present invention, generally speaking, by providing a single component developer composition, hereinafter referred to as a developer toner, for developing electrostatic images, comprising a resinous component having a sharp melt point and low melt viscosity which is essential for heat fusing and, further, having or exhibiting good melt-flow characteristics inclusive of good wetting properties in a short dwell time heat fusing environment. For purposes of the present invention, polyamide resins were determined to be highly suitable for use as the single component toner resinous component due to the sharp melting point characteristics and low melt viscosity of the polyamide, which is essential for short residence time heat fusing. Included as a component of the polyamide toner composition is a magnetic oxide material, generally present in an amount ranging from 40 to 75 percent by weight of the developer composition. The resulting polyamide-magnetic oxide toner composition possesses excellent melt-flow characteristics in that it exhibits a sharp melting point and low melt viscosity and flows evenly so as to become congruous with the substrate. Since the subject resins have good melt-flow characteristics, they inherently possess the capability to desirably wet out the highly loaded magnetic oxide particles in the formulation. This wetting-out characteristic and relatively good melt-flow property of the toner is also attributed to the presence of the specific magnetic oxide selected since the magnetic oxide has good dispersing characteristics and plays an important role in the melt-flow mechanism. The developer toner further preferably includes a highly conductive carbon pigment to control the conductivity of the resulting toner particle.

It has been determined in the course of the present invention that a single component developer composition or toner comprising a pigmented polyamide resin and a magnetic oxide additive exhibits the necessary characteristics which permit the toner to be used in a pressureless, heat-fusing electrophotographic imaging process while being capable of withstanding normally encountered shipping temperatures up to, for example, 125° F. for several days, without the toner particles blocking or adhering to one another in a normally used shipping container. Sharper melting type resins reduce cold flow tendency in that they do not tend to soften until the environmental temperature closely approaches the melting temperature. The utilization of the polyamide resin of the present invention will permit the formulation of a single-component toner with a magnetic oxide content ranging from 40 to 75 percent by weight. The low melt viscosity property of the resin aids in the ability to fuse the toner adequately at surface fusing temperatures of 215° F. to 225° F., at fusing rates of 3.8"/sec. It is generally known that heat-fusible toners usually provide for a cleaner background since pressure fusing rolls, heretofore used in conjunction with single-component toners tend to move the toner particles about on the surface supporting the electrostatic latent image, thus enlarging background particles as pressure is applied. The heat-fusible toners of the present invention are especially suitable for fabricating masters subsequently used for duplicating. The polyamide resins of the present invention provide for the required sharp melting point and low melt viscosity of 1000 centipoises or less of the resinous constituent which provides the desirable melt-flow characteristics when used in combination with the magnetic oxide component.

DETAILED DESCRIPTION OF THE INVENTION

In accordance with the present invention, a developer powder or toner is provided comprising in at least a major part, of a polyamide resin having a sharp melting point within the range of about 70° to 165° C., preferably within the range of from about 97° to 107° C., with a low melt viscosity. As used herein, the term polyamide resin refers to the polymerization product resulting from the condensation of polyamines with polybasic acids. In general, any polyamide resin produced according to the reaction set forth above may be used in the present invention, providing the melting point of the final resin composition is within the range specified, preferably within the range of 97° to 107° C. Below 70° C. there is a danger of the resin melting at the normal operating temperature of the electrophotographic apparatus, bearing in mind also that the toner compositions must withstand any high temperature that may be encountered during shipping without producing cold flowing. The sharp melting point polyamide resins reduce this cold flow tendency inasmuch as they do not soften unless the environmental temperature approaches very near to their melting temperature. Thus, the melt temperature of the polyamide resin utilized is maintained substantially above any shipping temperature which is contemplated. Temperatures above the upper limit generally will produce charring of the imaged copy sheets depending on the residence time, and are obviously undesirable.

Any suitable polyamide resin which satisfies the above requirements may be used in the course of the present invention. Typical polyamide resins are the Versamid 335, 712, 750, 930, 940 and 950, resins commercially available from Henkel Corp., and Polymid P-1155, P-4771, and P-1074, commercially available from the Lawter Chemical Company. It should also be appreciated that polyamides having melting points outside the stated range, such as Polymid 1084 available from the Lawter Chemical Company, may be used if combined with other polyamides so that the final resin composition has the desired melting point. Thus, a Versamid 900 resin, which has a melting point of 180° to 190° C., or a Versamid 100 resin, which has a melting point of 43° to 53° C., may be combined with other polyamides such as the P-4771 resin, to produce a polyamide composition having a melting point within the operating range of 70° to 165° C. The low melt viscosity resins, such as the P-4771 resin, are preferred, for their flow characteristics including viscosities of 1000 centipoises or less at their melting temperatures.

As referred to above, a highly conductive carbon pigment is added to the developer powder or toner in order to provide the particles with a surface coating which will render them somewhat conductive, so as to decrease the resistivity of the particle, and enhance powder flow processing. Other pigment materials may be used in combination with the conductive carbon pigment in order to produce various desired effects. The carbon particles will generally have a size ranging from 12.0 to 22.0 millimicrons (mμ) and will be added to the toner composition in an amount from about 0.5 to 4.0 percent, preferably 0.75 to 1.2 percent by weight based on the total weight of the toner. The conductive carbon is added to the toner or developer composition to impart thereto a resistivity ranging from 50 ohm-cm to $1\times10^5$ ohm-cm, and preferably $1\times10^2$ ohm-cm to $1\times10^3$ ohm-cm, to achieve the desired conductivity. Typical highly conductive carbon particles suitable for use in the present invention include Columbian CC-40-220 commercially available from the Columbian Chemicals Co., Vulcan XC-72R commercially available from Cabot Corp. and Printex L commercially available from the DeGussa Corp.

Any suitable magnetic oxide component may be added to the resinous toner composition which imparts the desired effect to the single-component developer of the present invention. Typical magnetic oxide materials include $Fe_2O_3$, $Fe_3O_4$, and various forms of magnetite. The magnetic oxide component is present in the toner composition in an amount ranging from about 40 to 75 percent by weight, and preferably from about 50 to about 70 percent, in order to achieve effective development and wetting properties. In such formulations the amount of polyamide resin present will range from about 60 to 25 percent by weight, and preferably 40 to 30 percent, always allowing for the presence of the pigment component for control of conductivity as described above.

The resulting developer or toner particles of the present invention are preferably classified so as to be present in the final developer composition in a size ranging from 8.0 to 40 microns, and preferably 12 to 35 microns in diameter. Particle sizes ranging from 6 to 8 microns may be present up to a maximum of 1 percent. It is preferred that at least 90 percent of the developer composition be comprised of particles ranging from 12 to 35 microns.

Any suitable technique may be used in order to prepare the developer composition or toner of the present invention. The polyamide resin may be mixed thoroughly with the pigment and magnetic oxide additive which have been previously reduced to the desired particle size. For example, ferric oxide particles available commercially in sizes of 100 to 500 millimicrons and carbon black available in particle sizes of from 9.0 to 50 millimicrons may be used. The resulting mixture is heated to about 180° to 200° C. to melt the polyamide resin and form a homogeneous melt which is blended and then allowed to cool and harden. At this point, the magnetic substance and carbon black, if present, have been distributed thoroughly and uniformly throughout the resin. The cold, hardened mix is then broken up and ground to reduce the material to a particular size of substantially about 8 to 40 microns, preferably 12 to 35 microns. In an alternate embodiment of the process above-described, the conductive carbon particles may be added to the polyamide-magnetic oxide blend, subsequent to the forming of the polyamide-magnetic oxide particles, or additional carbon particles added to the original blend, which effectively embeds the carbon in the surface of the toner particle. The presence of the conductive carbon pigment decreases the resistivity of the resulting toner particles, thus substantially enhancing the performance of the single component toner system.

DESCRIPTION OF THE DRAWINGS

The invention is further illustrated in the accompanying drawings, wherein exemplary copying systems utilizing the developer composition of the present invention are illustrated:

Referring to FIG. 1 there is seen an electrostatic copying apparatus adapted to utilize the developer or toner composition of the present invention wherein a photoconductive substrate 1 fed from roller 2 is uniformly electrostatically charged by corotron unit 3. The charged substrate 1 is selectively exposed to electromagnetic radiation at station 4 to form an electrostatic latent image on the surface thereof. The imaged substrate 1 moves past a development unit 10 comprising a magnetic roll 11, which rotates in a clockwise direction as indicated by the arrow, within a stationary sleeve comprising an insulative non-conductive polymeric material 12 superimposed on a non-magnetic metal layer 13. When in operation the magnetic roll 11 rotates within the sleeve to transport the toner particles 14 fed from toner dispenser 15, to the imaged member to develop the latent image areas of the photoreceptor 1. The toner particles have a charge applied thereto opposite to that of the image. The developed image on the substrate 1 is led to a fuser 16 where the toner image is fixed to the surface of the substrate 1. The imaged substrate then passes to processing unit 17 from which the final copy 18 is discharged into copy tray 19. The imaged copy may be used as a master for printing purposes depending upon the nature of the properties of the substrate.

Referring now to FIG. 2, there is seen an electrostatic copying apparatus, adapted to utilize the developer or toner composition of the present invention in a transfer system, wherein a cylindrical drum, generally designated 20, comprising a reuseable photoconductive material 21 such as selenium, is coated on support substrate 22. When in operation, the drum is rotated at a uniform velocity in the direction indicated by the arrow, so that, after portions of the drum periphery pass the charging unit 23 so as to apply a uniform electrostatic charge thereto, the drum surface passes beneath the imaging mechanism 24, herein represented as a scanning system, or other means for exposing the charged photoconductive surface to the image to be reproduced. Subsequent to charging and exposing, sections of the drum surface move past a developing unit, generally designated 25. The developer apparatus 25 consists of a fixed nonmagnetic sleeve comprising a cylindrical metal shell 27 and polymeric insulating layer 26 surrounding a rotatable magnet roll 28. The magnetic roll may be a magnetizable ceramic material that is magnetized to present alternate North and South poles about its circumference. The magnetic field is uniform along the axial length of the magnet. A bias polarity is applied to the toner particles opposite to the polarity which the photoconductive drum is electrostatically charged. Toner particles of the present invention 29 are supplied to the unit 25 from a dispenser 30. The toner particles 29 are rotated into contact with the imaged member while the magnet roll 28 is rotated in a clockwise direction, as indicated. The image thus developed continues around until it comes into contact with a copy web 31 from feed roll 32, which is passed up against the drum surface by two rollers 38 and 38', so that the web moves at the same speed as the periphery of the drum. The single-component toner of the developer is periodically replenished. A transfer unit 39 is placed behind the web and spaced slightly therefrom between the rollers 38 and 38'. This unit is similar in nature to the surface-charging mechanism 23 in that both operate on the corona-discharge principle. It should be noted that other transfer techniques may be utilized in conjunction with the present invention, such as adhesive transfer. After transfer of the toner image to the web 31, the web moves through the fixing unit 36 which serves to fuse or permanently fix the toner image to the web. After passing the transfer station, the drum continues around and moves beneath the cleaning brush 40 which prepares the surface for a new cycle of operation. The web is wound on roll 37.

PREFERRED EMBODIMENTS

Figure 1:
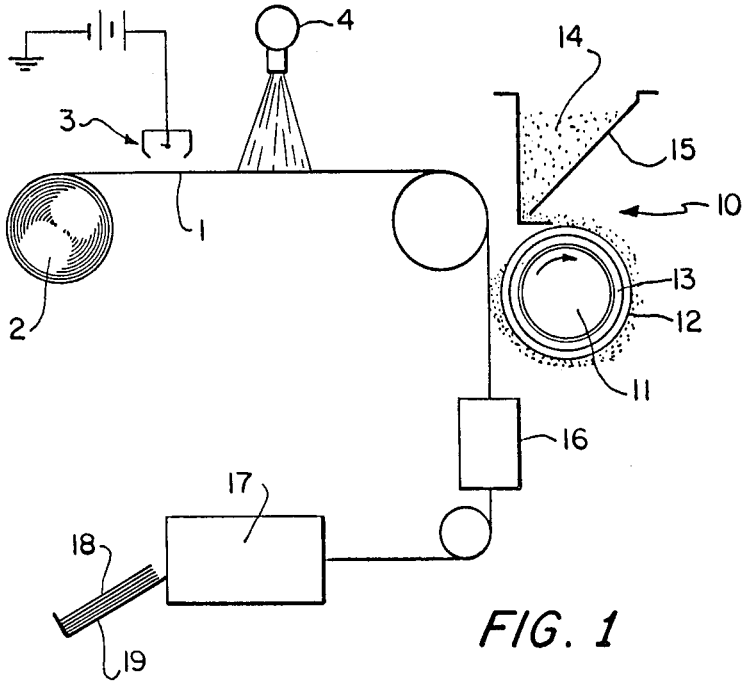
FIG. 1 representing a direct imaging system.
Figure 2:
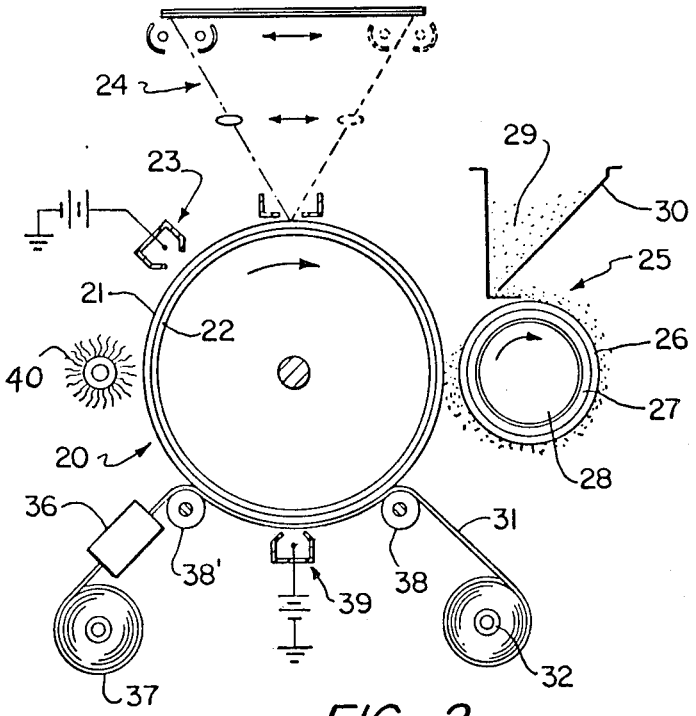
FIG. 2 representing a transfer imaging system.

To further define the specifics of the present invention, the following examples are intended to illustrate and not limit the particulars of the present invention. Parts and percentages are by weight unless otherwise indicated.

EXAMPLE I

A toner consisting of 25 parts of a polyamide resin P-4471 and 10 parts of a modified polyamide resin P-1084, both commercially available from Lawter Chemicals, Inc., 15 parts of a magnetic oxide MO-8029 commercially available from Pfizer, Inc., and 50 parts magnetic oxide MPB St'd. D commercially available from Indiana General is prepared according to conventional melt blend techniques and the resulting particles size-classified to obtain a toner having a volume average particle size of about 12 to 35 microns. Conductive carbon pigment CC40-220 is added to the toner up to about one percent of the toner composition.

An electrostatic latent image is formed on the surface of a photoconductive substrate, such as zinc oxide paper, by conventional electrophotographic techniques, developed and the resulting imaged photoconductor introduced into a fuser apparatus at a rate of about 3.8 inches/sec. for a period of time of about 3 sec. The surface fusing temperature reading for the toner measured in the range of from 215°–225° F. The images produced are of uniform high optical density, low background and excellent image definition.

EXAMPLE II

The process of Example I is repeated with the exception that the MO-8029 magnetic oxide is replaced with MO-7029. The conductive carbon content was determined to be about 0.75%. Similar results are obtained when such a toner is used for developing an electrostatic latent image.

EXAMPLE III

The process of Example I is repeated with the exception that the MPB St'd. D magnetic oxide is replaced by 318 M magnetic oxide commercially available from Mobay Chemical Corp. The conductive carbon content, in this instance Corax L, is measured to be about 1.5 percent. Similar results are obtained.

EXAMPLE IV

A toner consisting of 25 parts of polyamide resin P-3370 and 10 parts of modified polyamide P-1084 commercially available from Lawter Chemicals, Inc. and 65 parts magnetic oxide MO-7029 commercially available from Pfizer, Inc. was prepared in accordance with Example I and 1.25 percent XC-72R conductive carbon added thereto. The remainder of the process is substantially the same. Similar results were obtained.

EXAMPLE V

The process of Example I is repeated with the exception that polyamide resin P-1084 is replaced with the polyamide resin Versamid 940 commercially available from Henkel Corp. Similar results are obtained.

EXAMPLE VI

The process of Example I is repeated with the exception that the toner composition is altered to contain 29 parts of P-4471, 11 parts of P-1084, 14 parts of MO-8029 and 46 parts of MPB St'd. D. Similar results are obtained.

EXAMPLE VII

The process of Example I is repeated with the exception that the toner composition is altered to contain 21 parts P-4771, 9 parts P-1084, 16 parts MO-8029 and 54 parts MPB St'd. D. Similar results are obtained.

EXAMPLE VIII

The process of Example I is repeated with the exception that the electrostatic image is formed on a reuseable selenium photoreceptor and the image developed with the toner. The toner particles are next selectively transferred to a secondary support substrate, aluminized Mylar, and fused thereto according to the fusing steps of Example I. A high quality image is obtained.

EXAMPLE IX

The process of Example VIII is repeated with the exception that the toner composition of Example IV is substituted for that of Example I. The secondary substrate used is conductive paper. A high quality transfer image is formed on the paper substrate.

EXAMPLE X

The process of Example VIII is repeated with the exception of substituting zinc oxide paper for the aluminized Mylar. Similar results are obtained.

Although the present examples are specific in terms of conditions and materials used, any of the above typical materials may be substituted where suitable in the examples with similar results.

The invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An electrophotographic single-component heat-fusible developer composition comprising a low melt viscosity polyamide resin having a melting point within the range of from about 70° to 165° C. and a melt viscosity of 1000 centipoises or less, and magnetic oxide, wherein 90% of said composition comprises particles ranging from about 12 to 35 microns and not more than 1% of said composition comprises particles less than about 8 microns and a conductive carbon pigment in an amount of from about 0.5 to 4.0% of said composition, the conductivity of said carbon pigment being such so as to impart a resistivity to said developer ranging from 50 to $1\times10^5$ ohm-cm said developer composition having the capacity to develop an electrostatic latent image and being fixed by heat fusing, in the absence of pressure.

2. The developer composition of claim 1 wherein said polyamide resin has a melting point within the range of from about 97° to 107° C.

3. The developer composition of claim 2 wherein said magnetic oxide is present in an amount ranging from about 40 to 75% by weight of said composition.

4. The developer composition of claim 3 wherein said magnetic oxide comprises magnetite.

* * * * *